US008459734B2

(12) United States Patent
Herschler

(10) Patent No.: US 8,459,734 B2
(45) Date of Patent: Jun. 11, 2013

(54) BRIEFCASE WORKSTATION

(76) Inventor: Matthew Ballard Herschler, Shutesbury, MA (US)

( * ) Notice: Subject to any disclaimer, the term of this patent is extended or adjusted under 35 U.S.C. 154(b) by 91 days.

(21) Appl. No.: 12/844,819

(22) Filed: Jul. 27, 2010

(65) Prior Publication Data

US 2012/0079963 A1 Apr. 5, 2012

Related U.S. Application Data

(60) Provisional application No. 61/271,858, filed on Jul. 27, 2009.

(51) Int. Cl.

| | |
|---|---|
| ***A47C 4/00*** | (2006.01) |
| ***A47C 4/04*** | (2006.01) |
| ***A47C 4/12*** | (2006.01) |
| ***A47C 4/52*** | (2006.01) |
| ***A47C 1/00*** | (2006.01) |
| ***A47B 83/02*** | (2006.01) |

(52) U.S. Cl.

USPC ..... 297/139; 297/17; 297/135; 297/156; 297/170; 297/173; 297/174 R; 297/344.18; 297/440.1; 297/440.24

(58) Field of Classification Search

USPC ..... 297/17, 139, 170, 171, 172, 173, 297/174 R, 344.18, 440.24, 135, 156, 440.1

See application file for complete search history.

(56) References Cited

U.S. PATENT DOCUMENTS

| | | | | | |
|---|---|---|---|---|---|
| 33,398 | A | * | 10/1861 | Miller | 297/17 X |
| 88,256 | A | * | 3/1869 | Bacon | 297/156 |
| 168,402 | A | * | 10/1875 | Laumonier | 297/17 X |
| 283,175 | A | * | 8/1883 | Warner | 297/156 |
| 487,553 | A | * | 12/1892 | Cole | 297/156 |
| 630,427 | A | * | 8/1899 | Turner | 297/17 X |
| 779,202 | A | * | 1/1905 | Burgess | 297/156 |
| 893,694 | A | | 7/1908 | Allenson | |
| 908,487 | A | * | 1/1909 | Nail | 297/17 X |
| 1,265,977 | A | * | 5/1918 | Vordermark | 297/135 X |
| 1,275,649 | A | * | 8/1918 | Blando | 297/17 |
| 1,325,164 | A | * | 12/1919 | Mowrey | 297/17 X |
| 1,367,908 | A | | 2/1921 | Karschitz | |
| 1,380,153 | A | | 5/1921 | Kotun | |
| 1,476,144 | A | * | 12/1923 | Calvert | 297/17 X |
| 1,641,010 | A | * | 8/1927 | Peterson | 297/139 X |
| 1,895,338 | A | * | 1/1933 | Neumann | 297/174 R |
| 1,948,387 | A | | 2/1934 | Levy | |
| 2,282,296 | A | * | 5/1942 | Hollentonder | 297/139 |
| 2,418,731 | A | * | 4/1947 | Seitz | 297/139 X |
| 2,436,730 | A | * | 2/1948 | Repke | 297/139 |
| 2,613,728 | A | * | 10/1952 | Loibl, Sr. | 297/139 |
| 2,631,699 | A | * | 3/1953 | Schultz | 297/17 X |
| 2,638,702 | A | | 5/1953 | Holbrook | |
| 2,675,860 | A | * | 4/1954 | Schroeder | 297/139 X |
| 2,729,276 | A | * | 1/1956 | Volney | 297/17 |
| 2,982,338 | A | | 3/1956 | Ernst | |
| 2,805,707 | A | * | 9/1957 | Schoeppner | 297/139 |

(Continued)

FOREIGN PATENT DOCUMENTS

| | | | |
|---|---|---|---|
| EP | 0812554 | A2 | 12/1997 |
| JP | 06-009525 | U | 2/1994 |
| KR | 20-1987-0009411 | U | 7/1987 |

*Primary Examiner* — Rodney B White

(57) ABSTRACT

An equipment case, briefcase sized or larger, for carrying a laptop computer or other equipment, that opens and separates into two compartments, one forming a seat, the other a table; said equipment case as seat and table stabilized by their coupling.

5 Claims, 16 Drawing Sheets

U.S. PATENT DOCUMENTS 2,825,390 A * 3/1958 Post ..... 297/139
2,908,322 A * 10/1959 Taylor ..... 297/139
2,915,154 A * 12/1959 Holder ..... 297/17 X
2,971,570 A * 2/1961 Vander Bush ..... 297/17
2,991,829 A * 7/1961 Post ..... 297/139
3,023,046 A * 2/1962 Girling ..... 297/156
3,092,224 A * 6/1963 O'Neil ..... 297/17 X
3,177,991 A 4/1965 Walker
3,179,465 A * 4/1965 Roberts ..... 297/17
3,420,571 A * 1/1969 Moore ..... 297/135 X
3,475,050 A * 10/1969 Leahy ..... 297/17
3,476,456 A * 11/1969 Canavan ..... 312/231
3,662,932 A * 5/1972 Kerschner ..... 297/17 X
3,765,719 A * 10/1973 Silver ..... 297/170
3,885,829 A * 5/1975 Haeger ..... 297/139 X
4,070,057 A * 1/1978 Jones ..... 297/139 X
4,076,348 A * 2/1978 Allison ..... 312/231
4,111,482 A * 9/1978 Jones ..... 297/139 X
4,144,823 A 3/1979 Rathert
4,191,420 A * 3/1980 Fassett et al. ..... 297/17 X
4,223,945 A * 9/1980 Nikitits ..... 297/139 X
4,240,662 A * 12/1980 Anderson ..... 297/17
4,289,350 A 9/1981 Thomas et al.
4,482,185 A * 11/1984 Zoellner ..... 297/135
4,527,830 A * 7/1985 Meyers ..... 297/17 X
4,595,086 A 6/1986 Simpson
4,652,046 A * 3/1987 Compagnone nee Chatenay ..... 297/17 X
4,653,804 A * 3/1987 Yoo et al. ..... 297/139 X
4,790,416 A 12/1988 Baker
4,798,411 A 1/1989 Lin
4,799,731 A * 1/1989 Brown ..... 297/17 X
4,826,244 A * 5/1989 Choi ..... 297/139 X
4,883,314 A * 11/1989 Sakong ..... 297/139 X
4,921,302 A * 5/1990 Godwin ..... 297/170
4,974,870 A * 12/1990 Jarke et al. ..... 297/17 X
5,029,938 A * 7/1991 Song ..... 297/139 X
5,201,536 A * 4/1993 Bono et al. ..... 280/30
5,273,307 A * 12/1993 Jarke et al. ..... 297/17 X
5,310,208 A * 5/1994 Jarke et al. ..... 297/17 X
5,318,342 A * 6/1994 Hale ..... 297/17 X
5,333,928 A * 8/1994 Rollinson ..... 297/135 X
5,378,037 A * 1/1995 Beasley et al. ..... 297/174 R
5,474,356 A * 12/1995 Johnson ..... 297/156
5,628,544 A * 5/1997 Goodman et al. ..... 297/17 X
5,820,208 A * 10/1998 Miklinevich ..... 297/156 X
5,876,093 A 3/1999 Williams
5,967,600 A 10/1999 Jelacic
6,033,014 A 3/2000 Nightengale
6,068,355 A * 5/2000 Thorp ..... 312/241
6,186,589 B1 2/2001 Burkamp
6,186,593 B1 * 2/2001 Garneau ..... 297/188.01
6,209,952 B1 4/2001 Huang
6,302,032 B1 * 10/2001 Ranspach ..... 297/156 X
6,402,231 B1 * 6/2002 Pedemonte ..... 297/17
6,578,708 B2 6/2003 Barnett
6,604,783 B2 8/2003 Goodson
6,663,074 B2 * 12/2003 Prior ..... 248/461
6,883,863 B2 4/2005 Ginns
6,953,222 B2 * 10/2005 Larrick et al. ..... 297/172
7,314,248 B2 * 1/2008 Mabon et al. ..... 297/172
7,600,810 B2 * 10/2009 Chen et al. ..... 297/440.24 X
7,665,928 B2 * 2/2010 Winefordner et al. ..... 403/322.4
8,079,610 B2 * 12/2011 Winefordner et al. ..... 297/215.13 X
2004/0075327 A1 * 4/2004 Adams ..... 297/423.4
2007/0216201 A1 9/2007 Hart
2011/0012392 A1 * 1/2011 Herschler ..... 297/139
2012/0091765 A1 * 4/2012 Carroll ..... 297/188.11

* cited by examiner

& #19

& #19a

& #19b also #22
and #22a

& #46

& #44

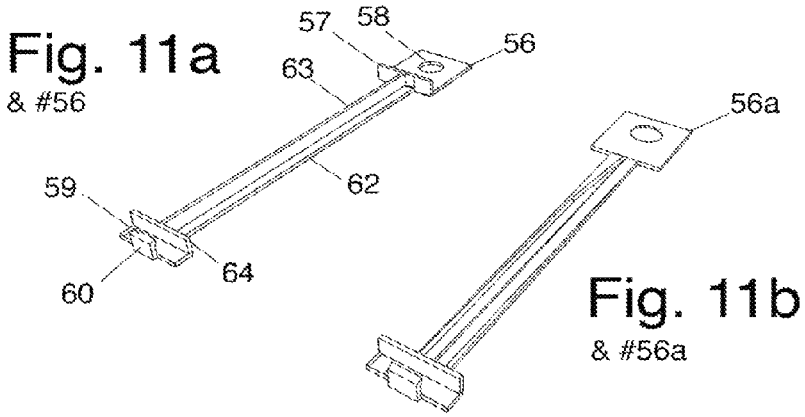
Fig. 11a
& #56
Fig. 11b
& #56a
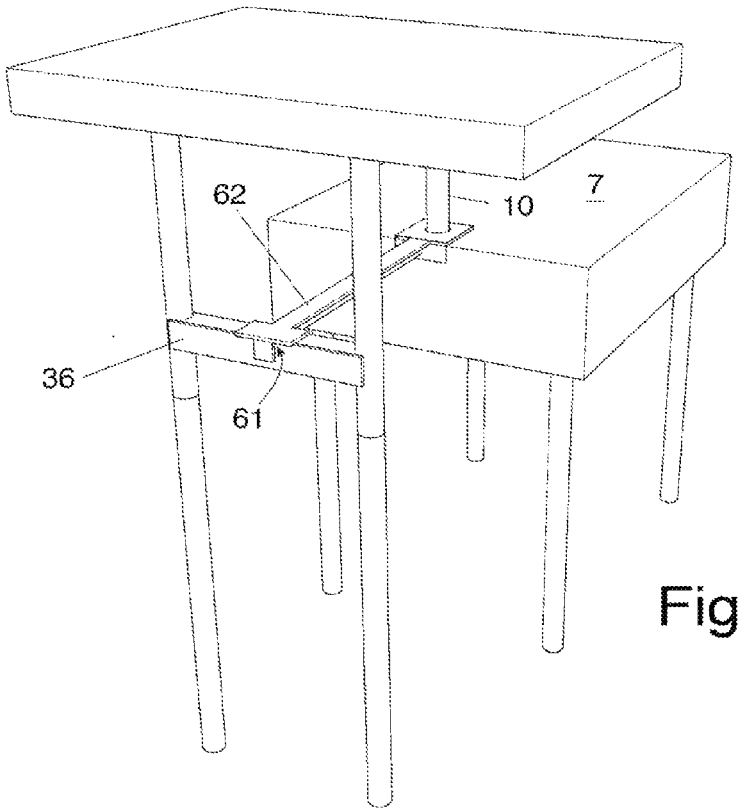
Fig. 11

& #75

& #83

& #97

Fig. 21
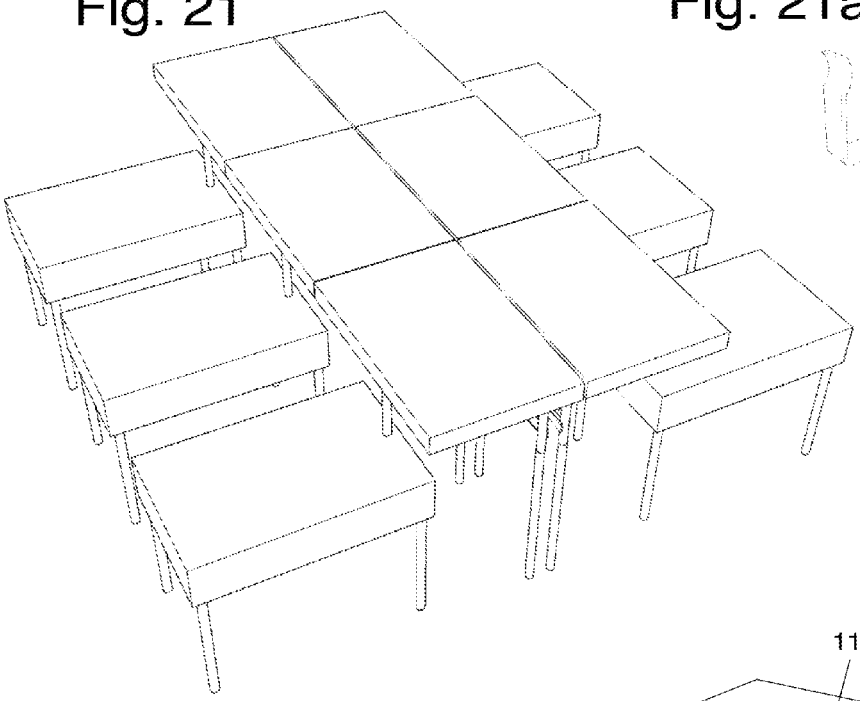
Fig. 21a
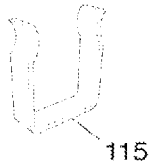
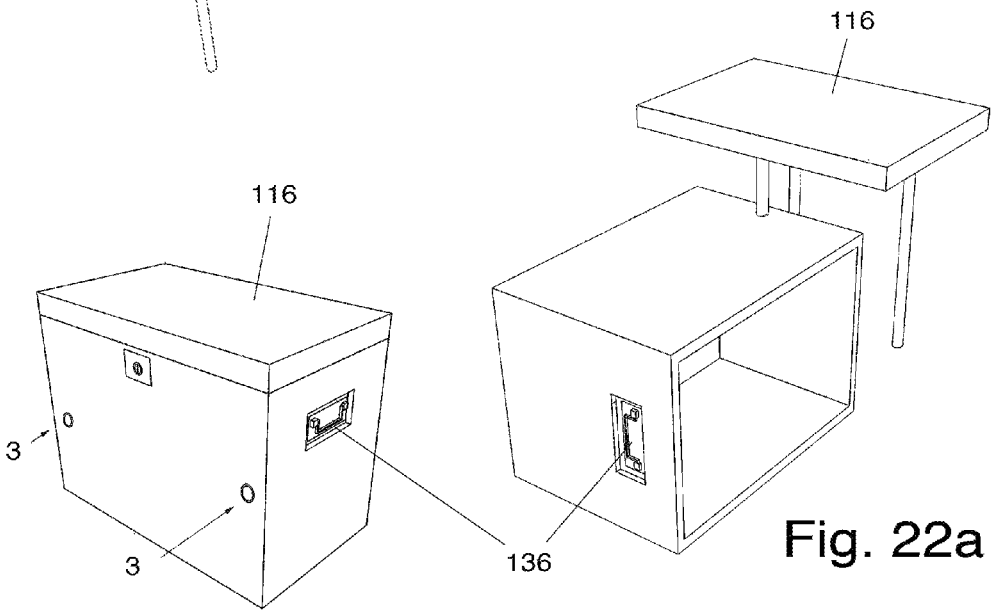
Fig. 22a
Fig. 22

Fig. 24
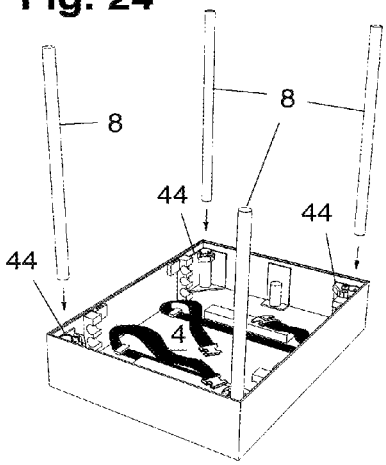
Fig. 24a
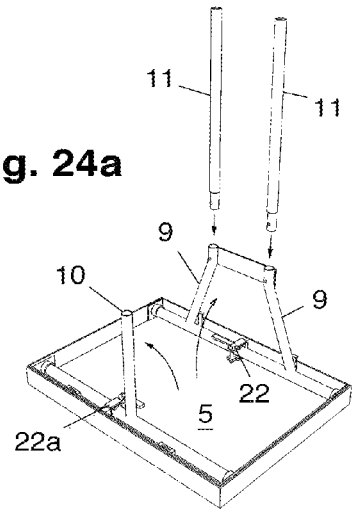
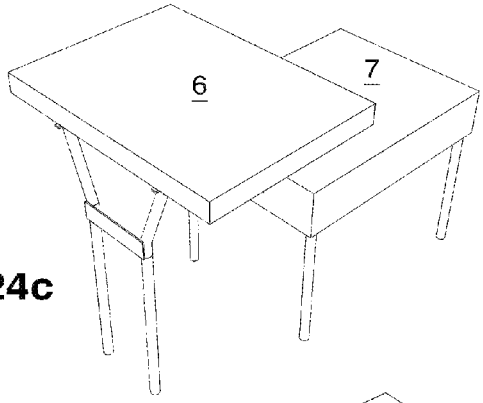
Fig. 24c
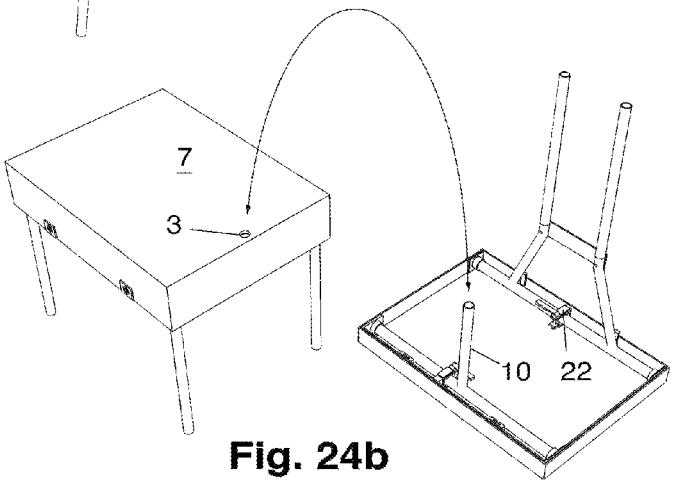
Fig. 24b

BRIEFCASE WORKSTATION

CROSS-REFERENCE TO RELATED APPLICATIONS

This application claims the benefit of 61/271,858 filed Jul. 27, 2009

STATEMENT REGARDING FEDERALLY SPONSORED RESEARCH OR DEVELOPMENT

Not Applicable

NAMES OF PARTIES TO A JOINT RESEARCH AGREEMENT

Not Applicable

INCORPORATION BY REFERENCE OF MATERIAL SUBMITTED ON A COMPACT DISC

Not Applicable

BACKGROUND OF INVENTION

People concerned with portable table and seat combinations have long been concerned with issues of lightness, ease of assembly and disassembly, stability, compactness, of ease of carrying and storage, and in the history of invention these efforts are well documented and there are many portable table and seat combinations having a single handle that are carryable in one hand and so appear more easily portable. Still, in the history of invention concerns for compactness and convenient storage have neglected the fact that a table actually becomes useful when you put something on it. Failing to recognize this concern and incorporate it into their design, table a seat units have typically used a folding table to make a compartment, and said folding table compartment to hold the seats. They have then boasted the compactness of the package and the ease carrying and efficiency of storage not realizing that with such interests up front they forced a person intent on using a portable table and seats to carry the things to make it useful in the other hand. Such oversight has produced a far less practical device than it appears. As obvious as this omission might seem, it plagues the field. So much so that only one patent U.S. Pat. No. 1,641,010 Peterson, and this from 1927, stipulates a folding table compartment that holds seats and a compartment for other things. And of course with the seats also stored inside, the case is bulky and less portable.

In the history of invention there is one portable table and seat in which the seats are not stored inside a table compartment (U.S. Pat. No. 3,765,719, Silver Oct. 16, 1973), but it too is driven by the interests of compactness: " . . . each of the individual parts fits compactly inside the hollow bench portion so that the entire assembly may be carried in a suitcase-shaped package and stored in a minimum of space." (1, 28-31). Failing to see the value of an improved storage space, it too falls short of securing a storage compartment. Instead, Silver teaches a compartment that is not only open at the top, but also has four holes in the bottom to receive seat legs.

SUMMARY OF INVENTION

A BRIEFCASE WORKSTATION is a portable brief case, the two sections of which that comes apart to make a seat and table respectively. In addition to holding the hardware required for such conversion, A BRIEFCASE WORKSTATION has room inside it for work or other activity related materials. As a workstation said BRIEFCASE WORKSTATION is remarkably stable, intended for professionals of all kinds, where a laptop or other equipment is part of the job, and field use is required, and certainly for travelers. From military applications, to stream side fly tying stations, or watercolor and calligraphy, to study on the go, A BRIEFCASE WORKSTATION makes it possible to carry the tools you need to work and a comfortable working space in an all-in-one case, and it's portable enough to bring most anywhere.

Though conceived as a travelers case, its stability and compact-ability make it also attractive for use where space is at a premium, for schools and churches and community centers, and even for families who want to be able to convert their living spaces to suit a variety of purposes. Also, though conceived as a brief case, its size is not limited to that.

There are many and excellent embodiments of said workstation possible, many materials with which to make the case, many mechanisms by which legs can fold or unfold, or attach and detach, many hardware solutions to allows the swiveling of the rear table legs, or their fixing in position, many alternate and remarkable embodiments that adhere to basic principles. [pg 3. line 1] The following disclosure can only begin to touch on them.

BRIEF DESCRIPTION OF THE SEVERAL VIEWS OF THE DRAWINGS

FIG. 11: assembled workstation with straddle support.

FIG. 11*a*: detail of the straddle support.

FIG. 11*b*: detail of more flexible straddle support.

FIG. 16 *b*: exploded view of twist lock table leg extension adapted for twist lock attachment to rear table leg.

FIG. 21: six workstations together.

FIG. 22: Trunk style workstation as trunk.

FIG. 22*a*: Trunk style workstation assembled.

FIG. 24: workstation assembly: seat compartment.

FIG. 24*a*: workstation assembly: table compartment.

FIG. 24*b*: workstation assembly: connecting the seat and table.

FIG. 24*c*: workstation assembly complete.

DETAILED DESCRIPTION OF INVENTION

Overview

Basically, the BRIEFCASE WORKSTATION is a case in two sections, a seat section and a table section. These sections come apart to form the table and seat. There are four seat legs. These are detachable and store in the seat section. There are two rear table legs. These are connected and swivel out from under the table. There is also a front table leg here termed pedestal support that the sitter straddles when sitting. This pedestal support also swivels out from the table compartment where it is stored. Two table leg extensions attach to these said rear table legs, so making the length together to support the back of the table. These leg extensions also store in said seat compartment. In addition to such leg hardware, there is mechanism to connect to two halves of the case and to lock it, means of storing detachable legs, of keeping materials in seat section when it is inverted, and finally means to carry it.

Figure 1:
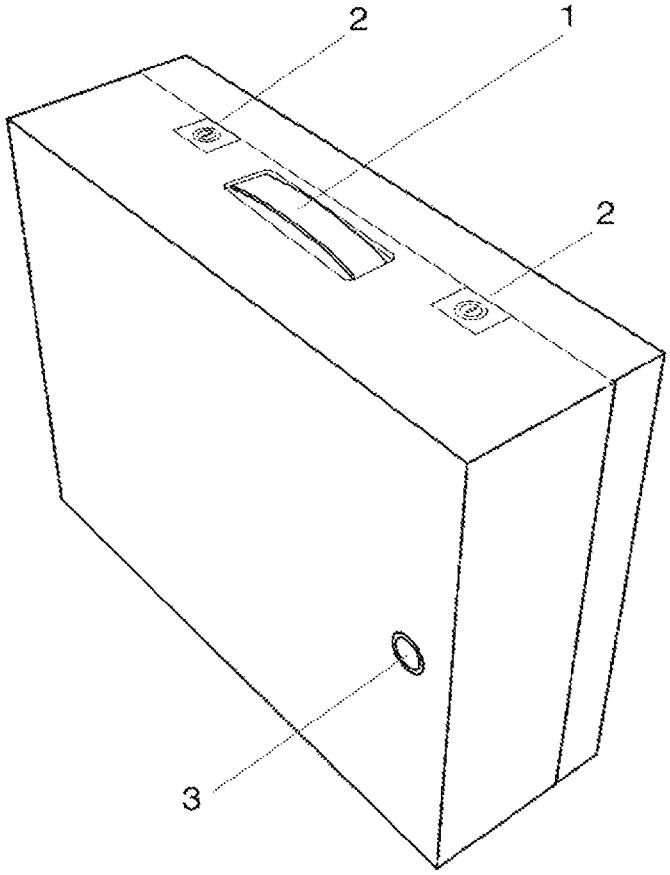
FIG. 1: briefcase workstation pictured as a briefcase
Figure 2:
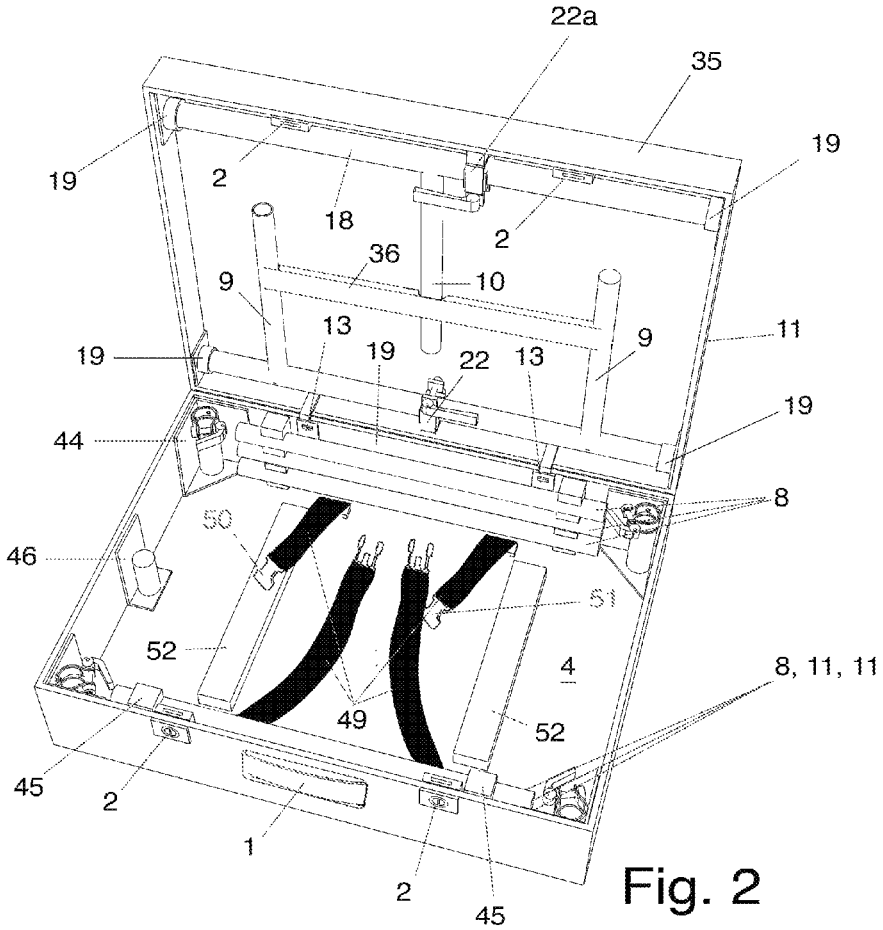
FIG. 2: briefcase opened to reveal mechanism and means of conversion
Figure 2A:
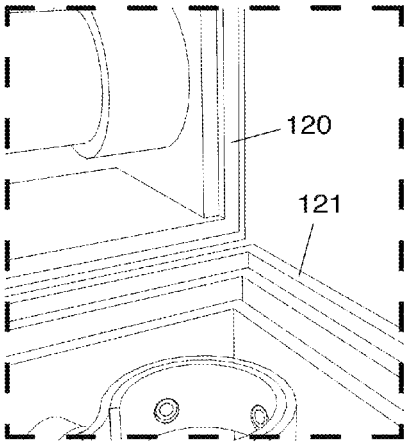
FIG. 2*a*: detail of case fitting
Figure 4:
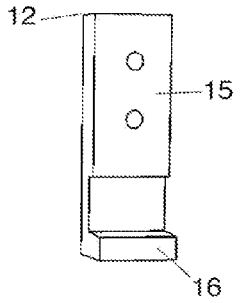
FIG. 4: detail of case hook.
Figure 4A:
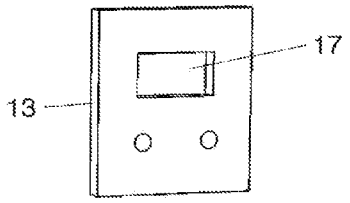
FIG. 4*a*: detail of case hook catch.

FIG. 1 shows the briefcase workstation as a briefcase with a handle (1) two locking button release latches (2) and a pedestal hole (3). In FIG. 2 this case is shown open. Its two compartments, the seat compartment (4) and the table compartment (5), make up the two halves of the case and detach from each other so that the backs of said compartments can make the tabletop (6) and seat (7). While separating hinges would suffice for such purposes, this embodiment shows case hooks (12) mounted to the back of the table compartment (5) that meet case hook catches (13) set in the back side (14) of the seat section. This has the advantage making the hardware invisible from the outside of the case. Shown in FIG. 4, the case hook (12) is very simply an L shaped metal strip bent slightly wide. The long side of the L (15) is attached to the back side of the seat compartment (14), with the short side of said L (16) overreaching the top edge of said back side and out over the case side. The case hook catch (13) is a simple flat with a slot in it to receive said case hook (16). Said case hook (12) is positioned on the back wall (14) of the table compartment so that when the back of the table compartment is brought together with the back of the seat compartment, they are aligned. Once so aligned, the front of said cases are brought together, and the two hooks (12) in the table section slipped into the case hook [pg. 6, line 1, 2, 3] catches (13). When these are properly set, such is a very snug and satisfying fit. FIG. 2*a* shows a raised lip on the table compartment edge (120) that fits inside a raised lip that rims the seat compartment (121), working to seal the case.

Figure 3:
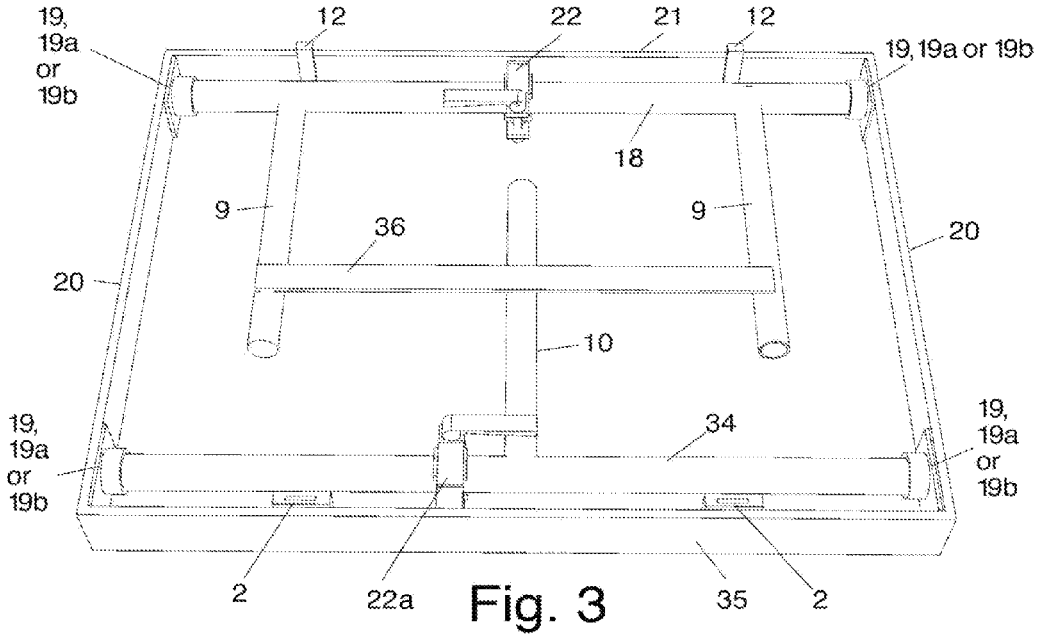
FIG. 3: table compartment detached from case with components revealed

The Table Compartment: FIG. 3

Installed into the table compartment (5) are three pipe legs. Two of these legs are back rear table legs (9) are connected by means of a rear leg connector pipe (18) that turns in two rear connector pipe housings (19) so that the legs can be swiveled between a stored and an upright position. These connector pipe housings (19) are mounted to the right and left sidewalls (20) at the back of the table compartment (21). A cam grip (22) works to hold the back rear table legs in a stored or upright position.

Figure 5:
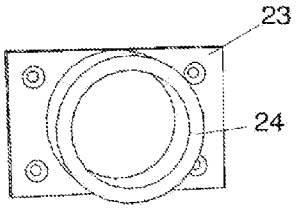
FIG. 5: detail of table compartment coupling.

FIG. 5 shows a pipe end housing (19) consisting of a pipe end cup (23) in which the connector pipe, FIG. 3 (18,34), fits very closely without chafing. Said pipe cup (23) is fixed to a mounting bracket or plate (24). The rear table leg connector pipe (18) is capped by connector pipe housings (19) on each end, and as such unit is installed into the sidewalls (20) of the seat compartment (4) snug to the back side (21).

Figure 5A:
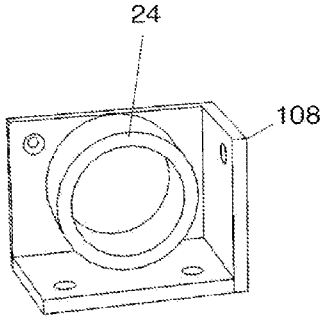
FIG. 5*a*: detail of table compartment coupling with 3 sided bracket.
Figure 5B:
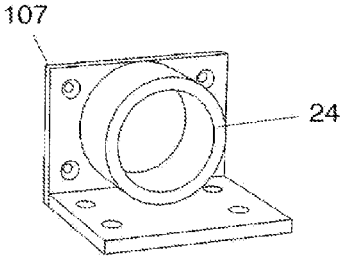
FIG. 5*b*: detail of table compartment coupling with 2 sided bracket.

Given the amount of stresses focused on the joint between said connector pipe housing and said seat compartment, and the huge diversity of materials of manufacture, FIG. 5*a*, 5*b*, concern modifications of the connector pipe end housing bracket. FIG. 5*a* shows the pipe cup (24) fixed to am L bracket (107). Said L bracket is meant to connect to both sidewalls (11) and the back wall (12) or to the bottom and side wall (11) of the table compartment (5). FIG. 5*b* shows the pipe cup mounted to a three-sided bracket (108), providing contact and opportunity for connection to the sidewall (11), the back wall (12), and the bottom of said table case (5). Recessed screw holes (109) are shown but means of attachment can be various given the requirements of various case and hardware materials The three sided bracket (108), like the two sided bracket (107) and the plate bracket (23) may be of any dimension that fits the case so affording where necessary more contact surface to improve hardware to case connections.

Important to say here regarding all situations where hardware must be attached to the case, the means of fixing such to said case are several and diverse and depend on tools and technology available and material involved. Riveting, gluing, welding or casting as one piece come to mind. Where injection or rotational molding is used, metal inserts can be placed in the molded material and metal screwed into. Where concern for strength and reliability persists, such hardware via their brackets can be mounted through the case to backing plates outside the case. Note here, that the case for both esthetic reasons and reinforcement may have a shell attached again in some number of ways or a protective covering applied, or both. Indeed, all interior hardware might be installed into a harness fitting the case and so working to disperse stresses on the case material.

Note on Alternatives to Pipe Legs:

While in this embodiment pipes are used in the table compartment, there is no requirement that the legs and connecting members be hollow. It is only the limited availability of materials that makes it so. Square hollow legs or even solid legs would also work excellently. Such alternate embodiments might in some cases require some hardware modification.

Also in the table compartment shown in FIG. 3, 3*a* is a rear table leg cam grip (22). Said grip is attached to the case embracing the back leg connector pipe (18) near the midpoint. Such cam style locks are common in quick release applications like bicycle wheel attachment, or for seats and handle bar adjustments also on bicycles. As such basic technology is very reliable, and quick to release, it is well suited for use with the BRIEFCASE WORKSTATION.

Figure 6:
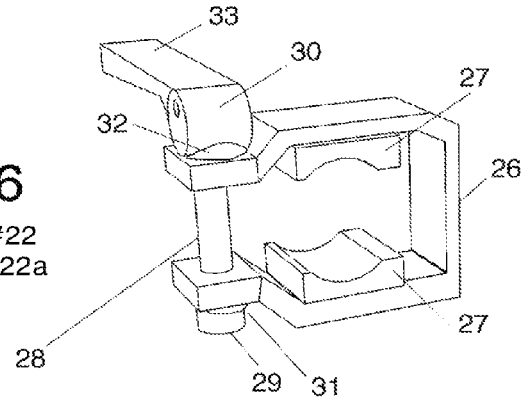
FIG. 6: detail of cam grip for the securing of table legs.

Detailed in FIG. 6, the rear table leg cam grip (22) is made up of a bracket (26) that circles the swivel bar on three sides, and mounts to the table case. In this embodiment said cam lock is mounted so that the cam lock bolt is to the side of the rear leg connector pipe (18). This cam lock has a cam bracket (26), gripping surfaces (27), a double threaded bolt (28) that works in conjunction with an adjustable end nut (29) and the cam lever nut (30) to set the angle and intensity of function. A lock washer (31) on the adjusting nut ends and a rubber washer (32) on the cam lever side set the adjustment. When the cam lever (33) is lifted the gripping surfaces release the connector pipe. When said cam lever is again lowered the gripping surfaces fix the connector pipe.

Figure 3A:
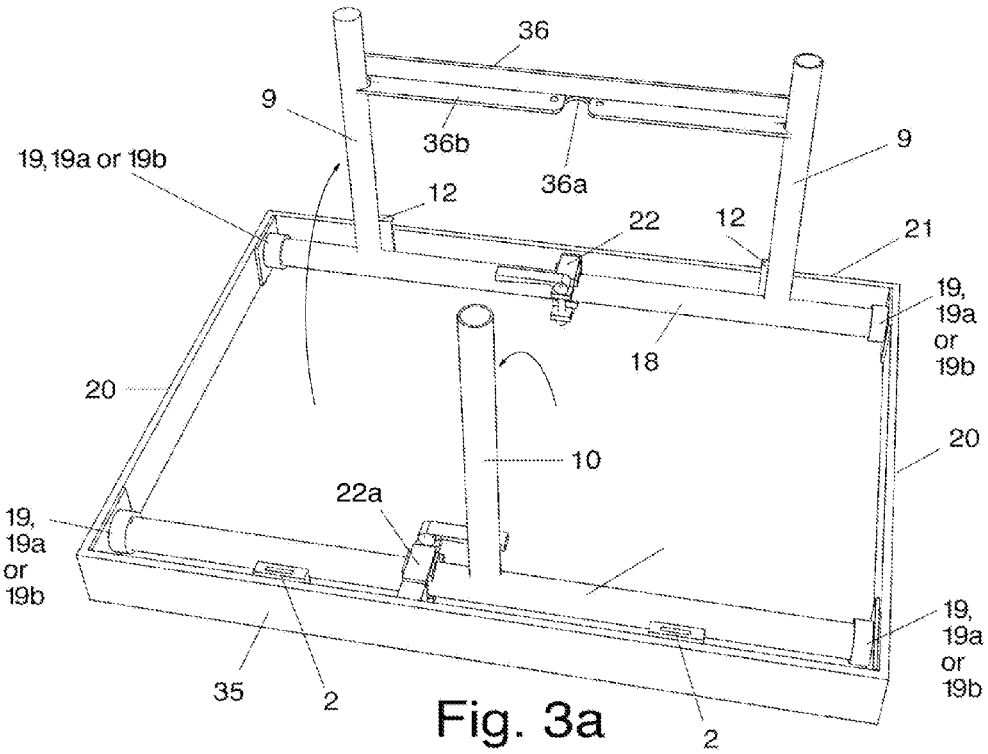
FIG. 3*a*: table compartment with table legs swiveled rotated to vertical position

In this embodiment a single cam grip (22) is set near midpoint between connector pipe ends (18). Said cam grip (22) works to set rear table legs (9) in perpendicular or stored position. FIG. 3*a* shows the table compartment with the legs fixed for use.

Front Pedestal Support

Again referring to FIG. 3,3*a*, the front leg of the table, also called pedestal support (10), extends from the center of the pedestal connector pipe (34). While this leg might be doubled and spaced for more stability, importantly, whatever their width, they are straddled. In this embodiment front pedestal support is a single pipe extending perpendicular from the center of the center of pedestal connector pipe (34).

Like the rear table legs, said front pedestal connector pipe is capped by pipe end housings (19). These housings are fixed also onto the side (20) of the table compartment at the front (35) of the table case (5). These pedestal pipe end housings (19) may be fixed exactly at the front side corners of the case so long there is room left for case latch assemblies (2). Also to mention, there are advantages to the pedestal pipe rotating past vertical, one being disassembly, another being seat to table distance adjustment. In such case additional stresses may be placed at these joints. To meet such stresses these front pedestal pipe housings may require specially adapted bracketing. FIG. 5*b* is once such modification. FIG. 5*c* shows another.

A second cam grip (22*a*), identical to (22) and shown in FIG. 6, is mounted at the front near center of the table compartment (5) so as to fix said pedestal support (10) by means of its connector pipe (34) in open and closed position. Cam grip (22*a*) is set near the center of said pedestal connector pipe but not on center as such would interfere with operation. As said pedestal pipe connector may be further from the front of the table case than the back connector pipe is from the back of the case, and as the firm mounting of said cam grip on both the back of the table compartment and the side may be essential to reliability, and again given the wide range of materials of manufacture, a longer cam grip bracket may be necessary.

Figure 7:
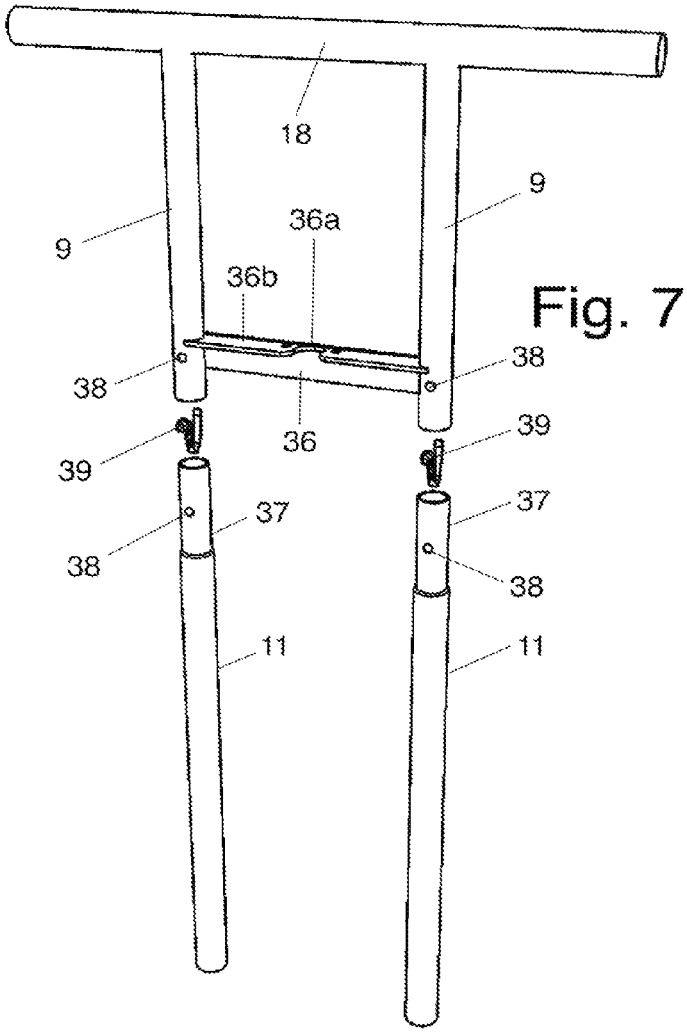
FIG. 7: exploded view of rear table leg assembly with extensions.

FIG. 7 shows the rear table legs (9) connector pipe (18) unit with a rear table leg cross member (36) set between the two legs near their extreme. While said cross member can be flat, or T or L shaped for added resilience, importantly, where there is a back bar (36*b*), there is a gap (36*a*) at the center of such cross member (36) to allow for the pedestal support. Referring to FIGS. 3 and 3*a*, when legs are returned to the case, said pedestal support (10) is first. Rear table legs (9) follow. The cam grip (22) on the rear table leg connector pipe, by fixing the said rear table legs (9), also fixes the pedestal support (10).

NOTE: In closed flush position the cross member holds the pedestal support (10) and there is no need to clamp it. Also, with pedestal (10) in vertical, its pipe end housings (19) are under considerably less potential stress than rear table leg pipe end housings. As such, in lighter duty applications, or where cost is a consideration, or where one wishes to retain flexibility, the front cam grip (22*a*) may be considered optional.

Connecting to the rear table legs (9) are two detachable extension legs (11). Again FIG. 7, along with 7*a*, 7*b* work together to illustrate. Each of said extension legs is of a diameter identical with the rear table leg with the exception that at the end where it inserts into said rear table leg. Here said extension leg (11) is of reduced diameter, this reduced segment here termed the head of the leg (37). These legs can be simply snug fitted together, but in this embodiment, to ever more surely fix the legs together there are pipe holes (38) in both the head (37) of the extension leg and in the rear table leg (9) near its extreme to accommodate a button spring catch (39) works to connect them.

The spring button catch itself (39) is comprised of a catch button (40) and a spring (41). The catch button has a lip around the base (42). When said spring button catch (39) is inserted into said extension pipe (11) so that said catch button (40) protrudes from the pipe hole (38), said spring works to keep said catch button pressed out of its pipe hole (38) and said lip (42) works to retain it. With the spring button catch (39) so placed, depression of the spring button (40) allows the extension leg to be inserted into the rear table leg. Full insertion of the head and possibly some twisting allows the spring button head to find its sistered pipe hole (38) in the rear table leg. Said button catch has a rounded head (43) to ease assembly.

NOTE: this is very common technology, one version of such described in Thomas U.S. Pat. No. 3,947,140 is for pipe extensions.

Figure 8:
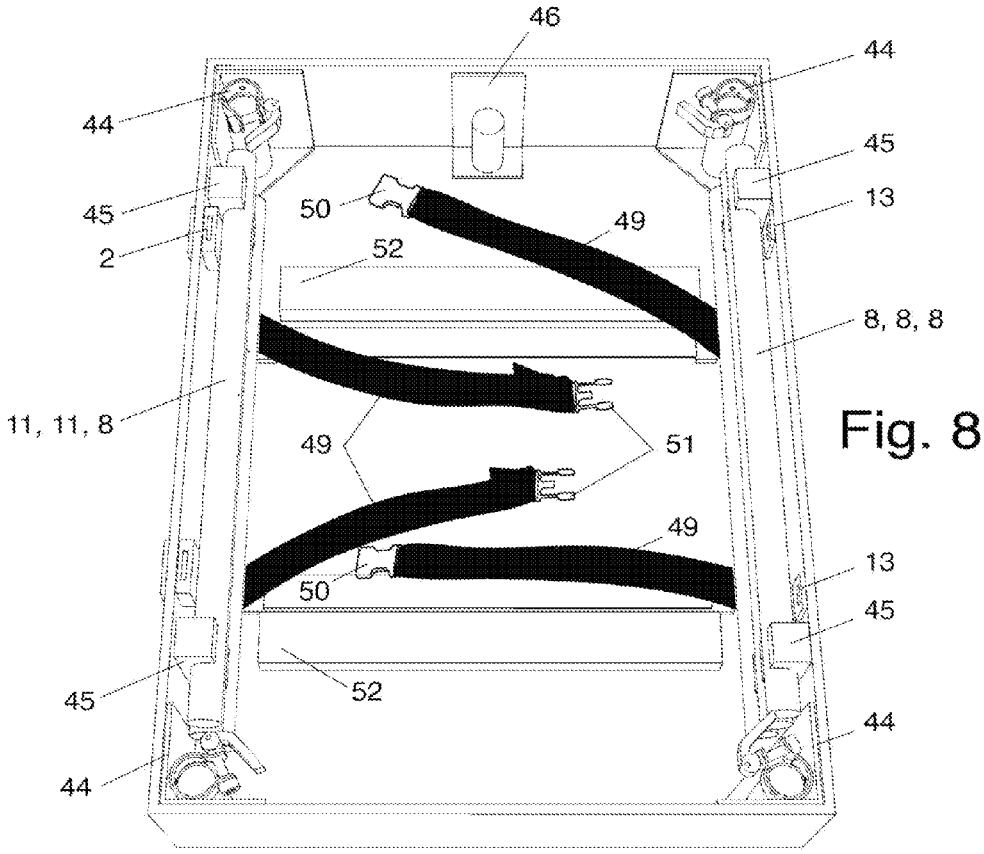
FIG. 8: detail of the uncoupled seat compartment.

More Specifically the Seat Compartment, FIG. 8.

Inside the seat compartment (4) and referring to FIG. 8 there are four leg receptacles (44), one set in each of the four interior corners of the case. These leg receptacles are set to hold the legs vertically out of the case so that when seat legs (44) are fixed in them flipping said seat compartment (4) transforms it into a seat (7). These same four legs (44) when detached from the leg receptacles are stored on the sidewalls of the case in foam retainers (45) fixed to the sidewalls. There is room for six legs on the sidewalls, three on each side.

NOTE: A vertical spring clip long and open at the top to hold said seat legs would allow consecutive storage and retrieval of the legs without disturbing the other contents, which in some cases might be useful.

Figure 9:
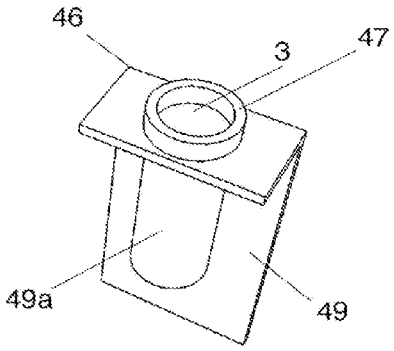
FIG. 9: detail of the pedestal support.

Also in the seat compartment is the pedestal housing (46). Detailed in FIG. 9, said pedestal housing is fixed against the bottom of the case and said sidewall at the midpoint. There is a hole in the seat compartment (4) to allow for the rim (47) of the pedestal cup (48). Said pedestal cup is open through the bottom of the seat case, the rim of which shows in FIG. 1, but closed on the seat compartment side. The hole (3) in the pedestal cup (49*a*) is shaped to accommodate the pedestal support of the table compartment. The pedestal cup (49) is fixed to a pedestal bracket (49) that faces both the bottom and the sidewall of the case. For added strength depending on materials an external faceplate for which said bracket to attach may be desirable.

Returning to FIG. 8, at the rear of the case are two case hook catches (13) as described fixed at the top edge and space spaced so as to align with case hooks installed in the table compartment (5). At the front of the case fixed to the top edge are two latches (2) also aligned with their sister latches in the table compartment. Also in the case compartment (4) are two sets of straps (49), fixed parallel to each other and to the floor of the seat compartment to hold whatever equipment might be stored there. With both ends of said straps (49) loose, side loose is fixed with a female strap catch (50), the opposite loose with its male counterpart (51), which inserts into said female and locks. After locking, the loose running from said male counterpart can be pulled to cinch the straps around whatever material is stored there. There is foam on the case floor in two strips (52) to keep materials from scuffling during transport. It is also possible to fix the legs by this manner should it prove convenient or the fuller width of the case be desirable to store some particular object.

Figure 10:
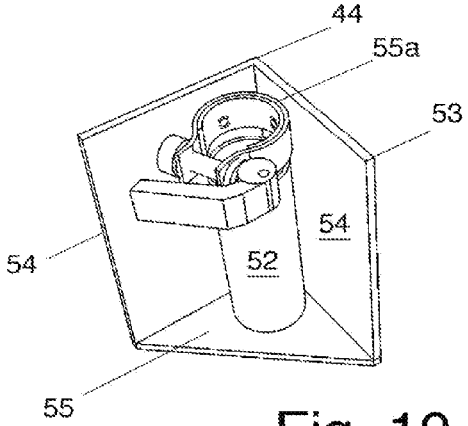
FIG. 10: detail of the cam grip style leg receptacle.

FIG. 10 details cam grip leg receptacle (44) installed into the four corners of the seat compartment. Each said receptacle has a leg pipe housing (52) set securely into a three sided bracket (53), with the pipe section laid between the two sides (54), and the bottom plate (55) closing the pipe. At the top of the leg pipe is a cam grip (55*a*) much like (22) detailed in FIG. 6. In this embodiment cam grip leg receptacle is preferred because it is adjustable. This to say that a person while sitting can reach under the case and loosen a particular leg and reset it when the ground is uneven. The leg for such mechanism is simple and straight and needs no addition or alteration, though at one end a cap is inserted to keep such leg from slipping or scratching floors.

Final Assembly

With seat legs inserted, the seat compartment (4) is flipped to make a seat (7). The pedestal support (10) is then fitted into the hole (3) at the front of the seat and so the pedestal support housing (46), and optionally fixed by reaching under the table to set the front cam grip (22*a*). FIGS. 24, 24*a*, 24*b*, 24*c* illustrate. FIG. 24 shows seat legs (8) being fixed into leg receptacles (44) in seat compartment (4). FIG. 24*a* shows inside the table compartment (5) the rear table legs (9) and the pedestal support (10) rotated to vertical position. The two table leg extensions (11) can now be attached to the rear table legs (9). Again, pedestal support locking is optional. FIG. 24*b* shows the seat compartment (5) flipped to become a seat (6) and table section assembled upside down. As arrow indicated, table section may now to be flipped, and the pedestal support (10) inserted into the pedestal support housing (3). FIG. 24*c* shows the assembled BRIEFCASE WORKSTATION, the table compartment converted to a table (7) and connected to the seat compartment (6).

Remaking the Case: FIGS. 2,1

When work is done, the four seat legs (8) are removed from their respective leg receptacles (44), the two desk leg extensions (11) are removed from their back rear table legs (9) and settled into foam (45) fixed to the side walls of the seat compartment (4). At such time the other equipment work materials may be packed into the seat compartment and strapped in. With all materials returned to said case and cinched, the table compartment (5) is fitted to the back of the seat compartment ease so that ease rims and case hooks (12) align to their case hook catches (13). So aligned, the fronts of said two compartments can be brought together. Gentle pressure works to secure the latches (2) on the front side of the case. Said latches in combination with said hooks (12) and catches (13) work to fix the table and seat compartments together, remaking the case.

To facilitate transport in this embodiment, a recessed handle (3) is attached on the latch side of the case between said latches. As a case, said workstation is easily transported, it is efficiently storable, even stackable, as with recessed handle and flush hardware, said briefcase workstations can be fitted together, like so many identical blocks. As such, it well suited to spaces that require conversion from classrooms to activity spaces.

Table Leg Reinforcement

Cross Bars and Triangulation Between the Two Legs

Figure 7C:
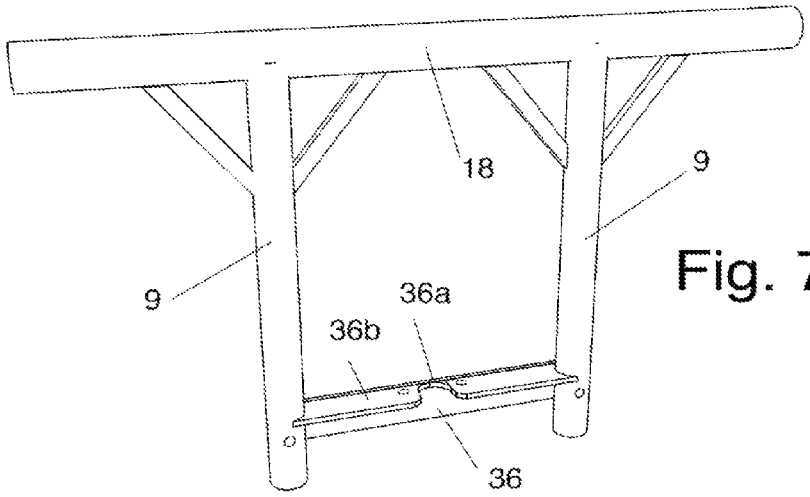
FIG. 7*c*: example of a reinforced rear table leg and connector pipe unit.

As it is important that the rear table leg and their connector pipe are solid and reliable, and given the wide variety of materials used in manufacture and their diverse strengths and weaknesses, FIG. 7*c* shows braces triangulating said rear legs (9) and said connector pipe (18).

Stabilizer

FIG. 11, 11*a* illustrate the used of an adjunct central stabilizer (56) that is fitted to the seat (7) at one end and to the table leg cross member (36) at the other. At the seat unit it has a front edge (57) to keep it from sideways motion. It also reaches over the top of the case and has a hole (58) that the pedestal support slips through on its way to the pedestal support housing. The other end of said central stabilizer slips (56) over the top of the cross member (36) at the middle and then down to clip onto said cross member. A clip (59) at the base of overhang (60) meets a bulge, indent, or recess (61) centered on the outside of the cross member (36). FIG. 3*a* shows a recess either side of (36*a*). The length of the central stabilizer is Teed with a flat top (62) and a central vertical rib (63) running the length underneath. This said vertical rib Tees with a front rib (64). Set at a distance to accommodate the flat bar and its reinforcement, so stiffening the joint.

Importantly, while it is traditional to have entirely fixed hardware solutions to address stability, rotatable coupling allows forces to be diverted when traveling through an object helping to disperse those forces. This said, this connection could be rubberized, or in some other way made softer to absorb impacts. FIG. 11*b* shows a central stabilizer that wins horizontal flexibility by eliminating the front edge (57) in FIG. 11*a*.

NOTE: The central stabilizer works to lock the table directly in front of the seat, making the fixing of the pedestal support in the pedestal housing redundant. It is my experience that such fixing is not required. When said BRIEFCASE WORKSTATION is in use, the table is very at hand, and the legs are between the sitter's feet. Should fixing be desired, a spring button catch inserted into the pedestal support (10) could find a hole in the pedestal support housing (46) facing front. Such housing could be placed close enough to the edge to allow a finger pressing to release it, or it could have a key, a button of a particular depth pressed into a button hole in the front of the case to release the pedestal, or a spring flap attached to the front of the case and held closed but a spring or catch of some kind, on a hinge. Opening said flap allowing the spring button in the pedestal support to enter said housing.

NOTE: when the journey case is unoccupied, as flexibility at the pedestal support greatly enhances stability, said stabilizer (56,56*a*) may be disconnected at the rear table leg cross member (36) and pulled off center to return horizontal flexibility to the pedestal support.

Pedestal Nose

Figure 12:
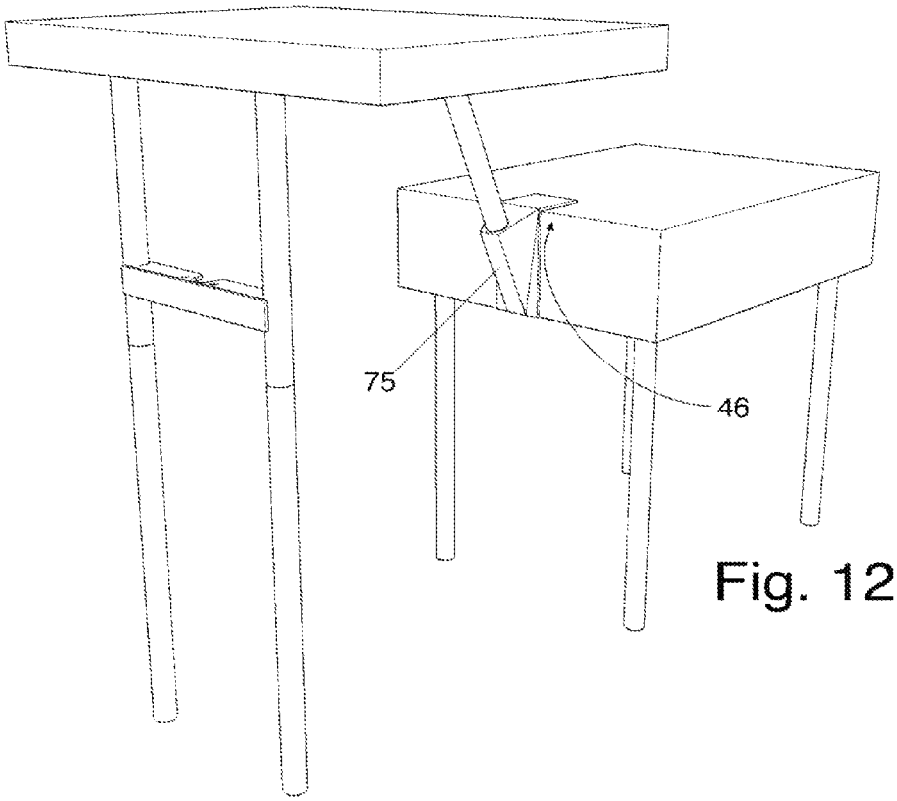
FIG. 12: assembled workstation with pedestal extender nose.
Figure 12A:
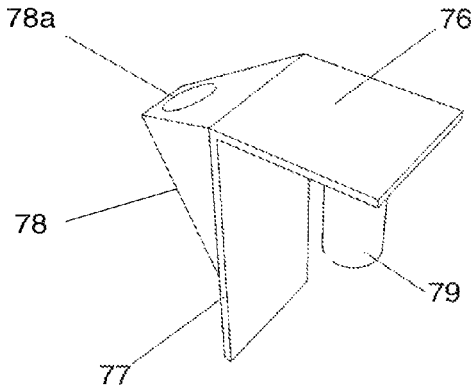
FIG. 12*a*: detail of the pedestal nose extender.

FIG. 12 shows the BRIEFCASE WORKSTATION with a nose adjunct (75) that fits into the pedestal housing in the case and over the front of the seat flush to the side. Referring to FIG. 12*a* where the nose adjunct fits over the top of the case and into the pedestal support housing (46) is called the mount (76). Where it fits over the front of the case it is called the drop (77). Fixed to said drop is a pedestal cup (78) which is positioned with a pedestal hole (78*a*) so as to hold the pedestal support (10) at an angle directly forward increasing the distance between table (6) and seat (7).

Preface to Leg Attachment

Detachable seat and table legs have not been well developed in modern technology, as such, means for such attachment was not evident and required invention. Three alternate means of attachment and detachment are offered here.

Twist lock attachment is a very satisfying means of connection as it requires no finger manipulation, just a hand grip and twist of the wrist. Twist lock attachment can be well applied to both leg reception in the seat case, and also to table leg extension. One particular method of twist lock is here offered as solution and detailed in FIGS. 14, 15,16, 16*a* 16*b*, 16*c*.

Figure 14:
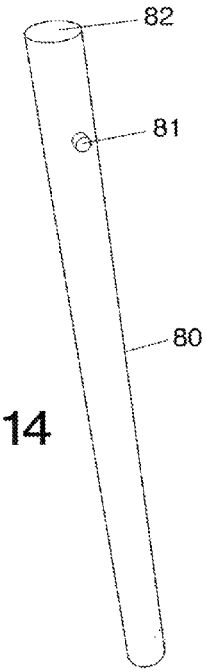
FIG. 14: detail of a twist lock seat leg.

FIG. 14 shows a twist lock style leg (80). Peg (81) is set a short distance from the top (82) of said leg on one side. Such peg (81) extends perpendicularly from the center of said leg a short distance and is only long enough to assure operation that is described below.

Figure 15:
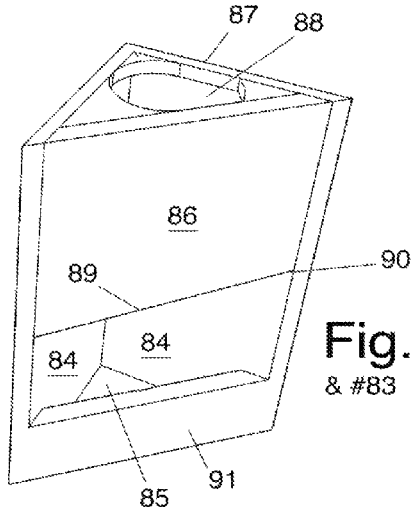
FIG. 15: detail of a twist lock leg receptacle.

FIG. 15 shows a remarkably simple receptacle for such a leg. FIGS. 14 and 15 together help to explain operation. The twist lock leg receptacle (83) consists of a three-sided corner bracket described in embodiments above with two side plates (84) and a bottom plate (85). A front plate (86) connects the two side plates at a 45 degree angle. The top (87) of the leg receptacle is open at the center to allow the insertion of said leg, with said front plate (86) and said two side plates (84) positioned so said three plates together make the space between them to exactly suit the diameter of said leg (80). The top of the leg receptacle (87) is also open on the right side (88) to accommodate the peg (81) on the leg (80). This works to show the user which way to insert the leg. It also works to reinforce the leg receptacle against deformation. The bottom edge (89) of the faceplate (86) is angled with the right side reaching about midway (90) along the edge of the sidewall (84), and the left side of said faceplate reaching further down its adjacent side plate. This is so that when the leg (80) is near fully inserted into its leg receptacle (83), the turning of said leg clockwise works to fix said leg inside said leg receptacle. A last plate, a knee plate (91) is attached to the bottom plate (85) and a short distance along both sidewalls (84). This knee plate (91) works to assure that the leg top (82) is firmly positioned also against the two sidewalls (84). Such knee plate (91) also works to assure the structure of the leg receptacle (83). Finally some softening of components edges, especially around the leg top (82), where it enters the leg receptacle (83), and even where it passes the knee plate (91) may ease operation.

Figure 16:
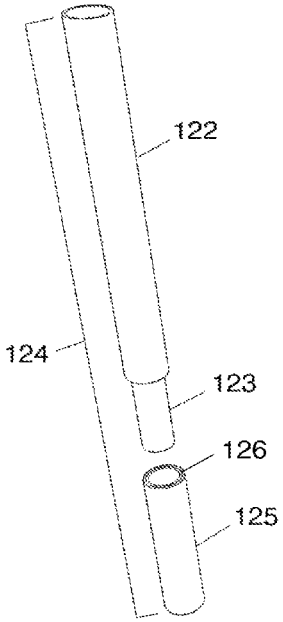
FIG. 16: exploded view of the twist lock mechanism as applied to rear table leg for purposes of leg extension.
Figure 16A:
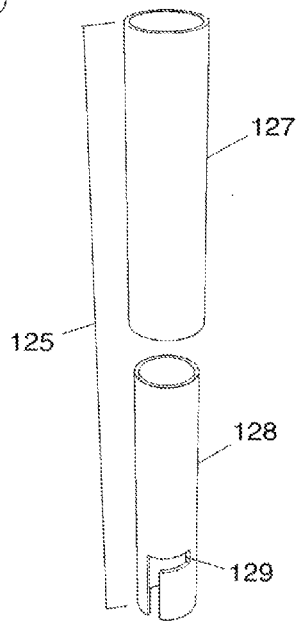
FIG. 16*a*: exploded view of the twist lock connector housing attached to rear table leg.
Figure 16B:
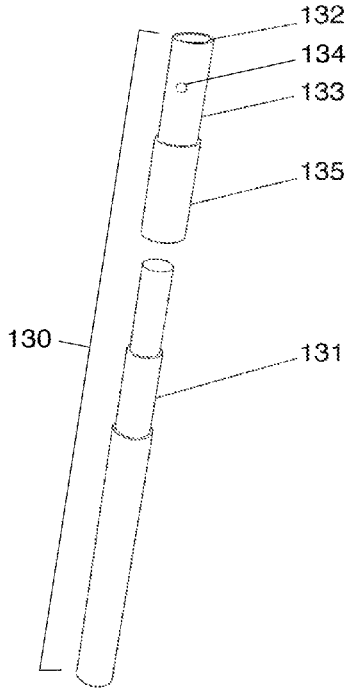

FIGS. 16, 16*a*, and 16*b* detail twist-lock technology intended for solid leg members and their extensions. FIG. 16 is an exploded view of the leg member (122) and the twist lock connector housing (125) that come together to form the rear table leg (124). In this particular embodiment said leg member (122) is of reduced diameter (123) where it enters the top (126) of the connector housing (125). Importantly this reduced diameter keeps said leg member (122) from entering said connector housing (125) more than half way. How the leg member and the extension housing are connected depends on materials. In wood and metal, as this is originally conceived for, a single rivet might serve, or spaced cross rivets, or a series of small short spikes driven through the extension receptacle into the leg, with such spikes welded into the surface and polished smooth.

FIG. 16*a* is an exploded view of said connector housing (125) consisting of an outer pipe (127) and an inner pipe (128). The outer pipe is simple and smooth. Said inner pipe also has a cutout (129). With said inner pipe (128) and said outer pipe (127) connected said cutout (129) becomes a slot that works to accept and lock the extension leg via its peg. Said cutout is shaped also so that once the inserted leg has near reached its extent, turning works to tighten it. FIG. 16*b* details the extension leg (130) showing it to be comprised of a leg body (131) and a sleeve (132). Said sleeve (132) sleeves said leg body (131) and being of similar component materials to the leg member (122) and its connector housing (125) is attached similarly. One difference is that the diameter of the leg body (131) is stepped down twice to accommodate the sleeve (132). Said adjunct (132) has a hollow leg top (133) with peg (134) connected to a pipe section of wider radius (135) which works to set the limit of entry into the connector housing. At its upper end said sleeve (132) is flush with the extension leg body (131).

Figure 17:
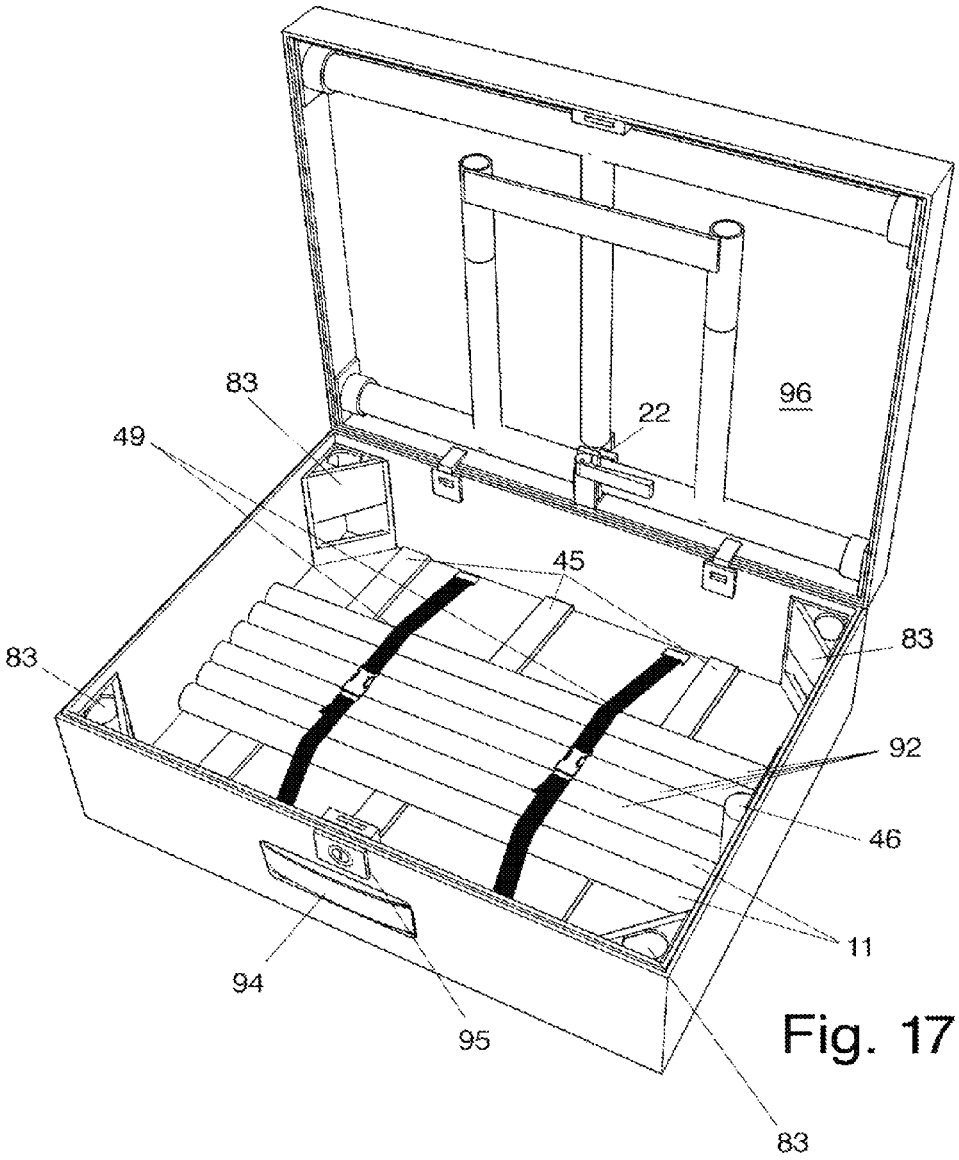
FIG. 17: smaller suitcase workstation with twist lock leg receptacles and alternate leg storage.

FIG. 17 shows an embodiment of said briefcase workstation with the above detailed twist lock technology. This is a notably smaller case as seat legs (92), in the manner of (80), require the near full extend of the seat compartment (93) for storing. For such reason, means of holding legs to the sides of said seat compartment are eliminated. In this embodiment, the legs (92) are held by the cinch straps (49) and by foam strips (45), both set to the bottom of the seat compartment (93). Where more equipment is included, the legs may be placed again on bottom, or on top of such equipment. The seat compartment also has an unrecessed handle (94) so as not to interfere with a single central latch (95). Also different in this embodiment, the table compartment (96) has only one cam grip component (22) applied to the rear leg connector pipe (93). Besides economy, such builds in stabilizing flexibility.

Even unoccupied, the BRIEFCASE WORKSTATION is remarkably stable. This stability is won by having the seat and table detachably coupled. It is further enhanced by having said coupling horizontally and a vertically rotatable, and so diverting impacts and compounding resistances. FIGS. 18*b* through 18*g* illustrate this coupling in operation. FIGS. 18*b* and 18*c* illustrates how an impact is dispersed horizontally. FIG. 18*b* shows an overhead view of A BRIEFCASE WORKSTATION. Where the table is jarred with an impact (I), the pedestal support where it meets the seat becomes a pivot point, here described as horizontal pivot one (hP1). FIG. 18*c* shows horizontal pivot point one (hP1) rotating some of the initial impact (I) into horizontal force two (hf1). This rotation works to move the table leg toward the rear seat leg, effectively closing the distance between front table leg and rear seat leg, noted as (x), and bracing against initial impact (I). As the pivoting at (hP1) is induced by resistance, the weight of the seat, depending on the force of impact (I), FIG. 18*c* describes a second rotational diversion of force (hf2) as it is related to a secondary horizontal pivot point (hP2). This secondary pivoting deflection of force is common to singular objects at rest when struck indirectly.

Figure 18D:
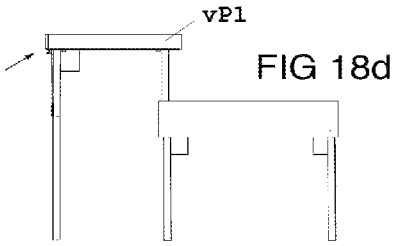
FIG. 18*d*: side view of briefcase workstation showing potential impact point and vertical pivot point.
Figure 18B:
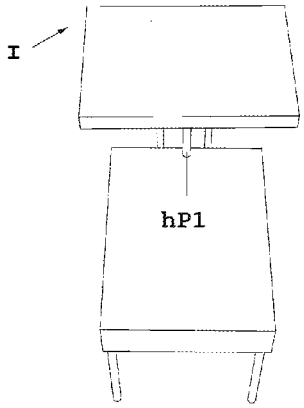
FIG. 18*b*: top view of briefcase workstation showing potential impact point and horizontal pivot point.
Figure 18E:
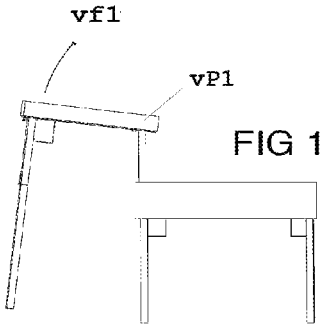
FIG. 18*e*: side view of briefcase workstation showing first level vertical reaction to impact.
Figure 18C:
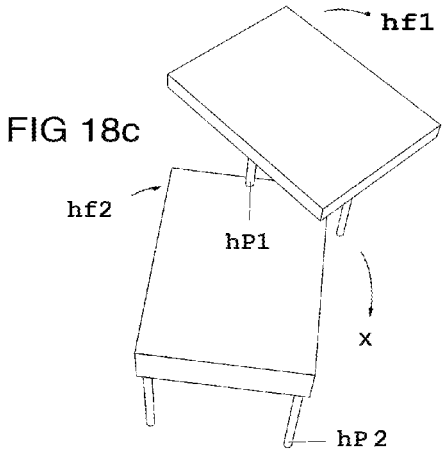
FIG. 18*c*: top view of briefcase workstation showing horizontal reaction to impact.
Figure 18F:
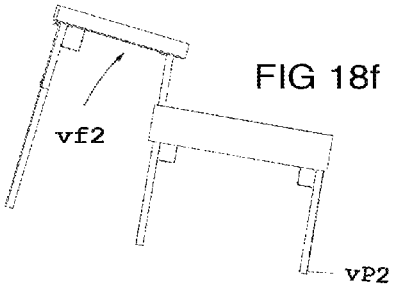
FIG. 18*f*: side view of briefcase workstation showing second vertical pivot point and second vertical reaction to impact.
Figure 18G:
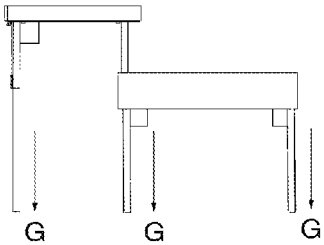
FIG. 18*g*: side view of briefcase workstation showing a gravity return.

FIGS. 18*d* through 18*g* detail a similar double absorption effected by a vertically rotatable coupling. FIGS. 18*d* and 18*e* shows vertical pivot point one (vP1) activated by an impact (I) and resulting in vertical rotational force one (vf1). Note that fixed seat and front table legs are marked with fixed right angle geometric notation. FIG. 18*e* illustrates effect of impact (I) the pivot point vP1, and translation into vertical force vf1. While this pivot point reaches its limit quickly, FIG. 18*f* shows residual force creating a bucking effect as a second vertical force (vf2) it instigated in relation to a second pivot point (vP2). FIG. 18*g* shows gravity acting on all parts of the workstation to resettle the unit.

Figure 19:
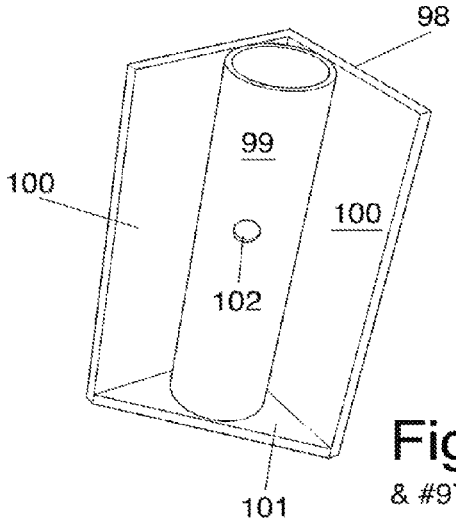
FIG. 19: detail of a spring button lock style seat leg receptacle.

Spring button catch technology is common and widely known, and is a potentially universal solution for all situations requiring pipe fixing and release. FIG. 7, 7*a*, 7*b* regard rear table leg extensions (11) and are detailed above. FIG. 19 shows spring button technology applied to a leg receptacle (97). Such leg receptacle (97) consists of a three-sided leg receptacle bracket (98) detailed in other leg receptacle disclosures. A pipe housing (99) is attached between the two side plates (100) adjacent to each. This pipe housing (99) is capped at one end by the bottom plate (101) and open at the top to receive a leg in the style of the extension legs (11). Such pipe housing (99) also has a hole (102) exposed to the outside open side of the leg receptacle (97) midish way between its ends. Such hole (102) is placed to receive the spring button (40) protruding from the spring button catch leg styled like extension leg (11).

External spring button catch technology is also widely known and a potentially universal solution for all situations requiring pipe fixing and release. FIG. 20 shows an external spring button catch styled leg receptacle (103). Such receptacle is virtually identical to the receptacle detailed in FIG. 19 with the exception that there is in addition a cross plate (104). Such cross plate (104) is attached to the leg pipe housing (99) at the on the side of said pipe housing at the top (105) and to both side plates (100) also at the top, not to interfere with the open end of said leg housing. An external spring button catch (106) is fixed to the cross plate (104) and detailed in FIG. 20*a*. Such external spring button catch (106) consists of a handle (107) like the half of a clothes pin with a button (108) styled like (42) attached at the tip of lower end of said handle on the side that's hidden in use. Said handle (107) has a tongue (108) near its middle that hooks into a recess (109) at the lower extremity of the catch mount (110). Capping the recess (109) and so forming it is a small bar (110*a*) that the tongue (108) in the handle (107) curls around. A spring (111) set between said handle (107) and the catch mount (110) works to separate the top end of the handle (112) from the top of the mount (113). Such spring (111) also works to hold the handle (107) and the mount (110) together and to press the button catch (108) into the hole (102) in the leg pipe housing (99). Finally, in this embodiment at the top of the mount there are two forks (109) set back from the regular mount surface the width of the cross plate material, and placed such that the assembled external spring button catch (106) may be slid as a unit into place along said up along the pipe housing (99) and under the cross plate where it clips in or is otherwise secured.

Figure 20B:
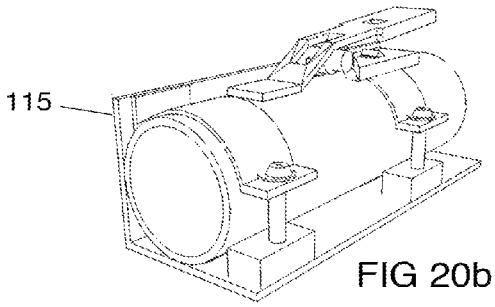
FIG. 20*b* external spring clip applied to connector pipe.
Figure 20:
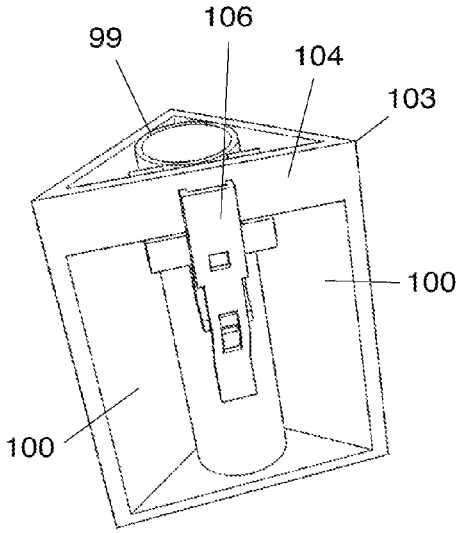
FIG. 20: detail of an external spring clip seat leg receptacle.
Figure 20A:
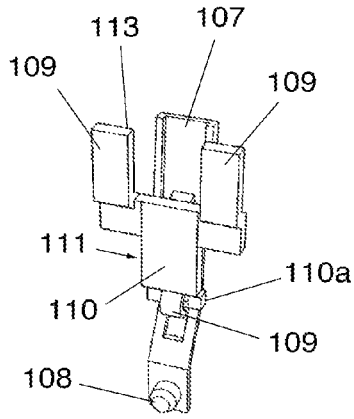
FIG. 20*a*: detail of external spring clip for seat leg receptacle.

FIG. 20*b* shows the same spring button catch technology applied to an open ended pipe housings as an alternative means of fixing rear table legs. The open-ended external button catch functions similarly to the similarly styled leg receptacle (FIG. 20, 20*a*) but has a two-sided bracket (115). In this embodiment this two-sided bracket (115) is the length of the pipe housing. As such it offers a great deal more contact with the bottom and the sidewall of the table case. Should the reliability of the connection of the rear table legs to the case be of concern, said external spring catch mechanisms become doubly useful.

FIG. 21 shows a number of assembled work stations joined together to form a meeting table. While such tables may simply be positioned as such, where it is desired they may be connected by "C" clips FIG. 21*a* (115) slipped over adjacent table sides from underneath the table tops (6). Where there is want for more legroom and or a completely flat surface as in impromptu conferences or steadying larger equipment or sharing food etc. . . . Also, a large board or legless tabletop is shown placed over a number assembled workstations and well supported by them. Such tabletop might be thin and light, and not completely rigid and still serve adequately given the support said assembled workstations afford.

While we have been talking about traditional and brief case proportioned cases, so long as two parts of the equipment case separates to form the table and seat section respectively the essence of the invention is satisfied. To give just one case example FIGS. 22 and 22*a* shows a simple trunk with standard trunk handles (136). The lid (116) of said trunk separates to make a table. There is no need for seat legs, as the compartment forms the seat. Also notice that the pedestal support (3) is on the side of said compartment and not, as in previous embodiments, on the bottom. This means that the compartment lies with the open side beside the sitter, making such equipment as is stored there easily available to the user. Such cases can be right handed, or left-handed, or, with two pedestal holes, ambidextrous.

Figure 7A:
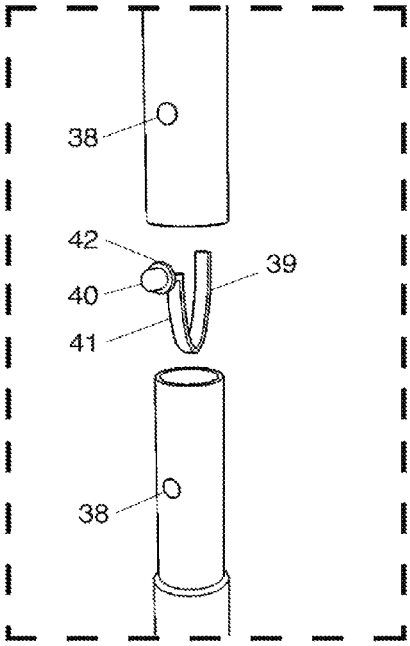
FIG. 7*a*: separated view of the internal pipe spring button catch.
Figure 7B:
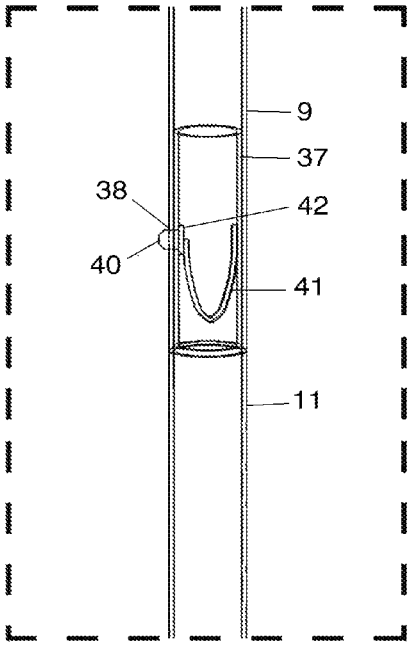
FIG. 7*b*: transparent view of the internal pipe spring button catch.
Figure 23:
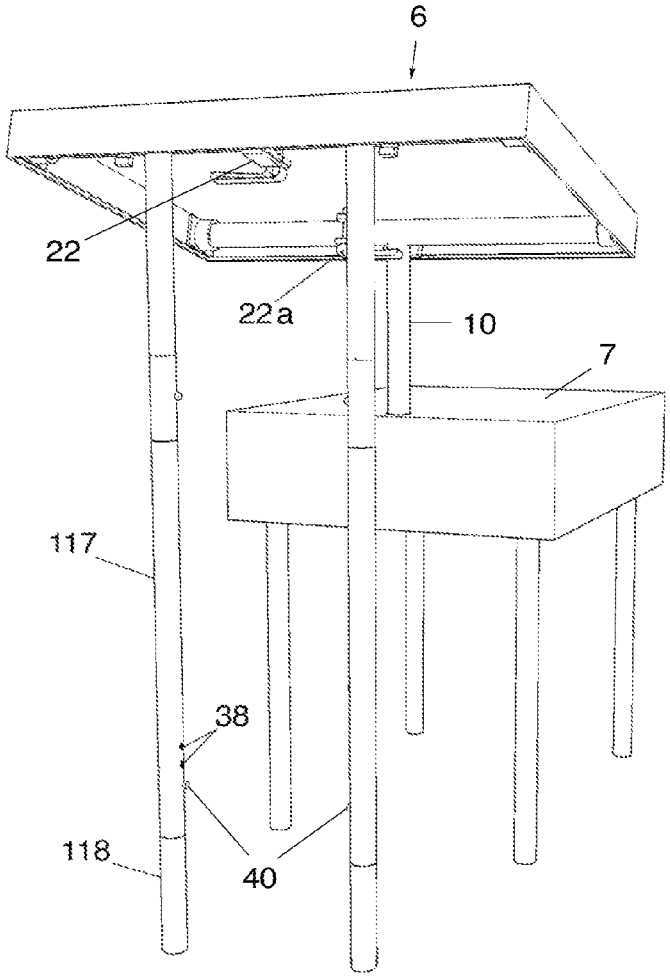
FIG. 23: workstation with means for angle adjusting table top.

Finally in this disclosure, it may be desirable to have a table top (6) whose angle is adjustable. There are a number of means to accomplish this. One solution is to lengthen the back legs. FIG. 23 shows the assembled workstation with rear table legs (9) and telescoping extension legs (117) in the style of extension legs (11) but with telescoping inserts (118) extending out the bottom of said extension legs. The length of said telescoping extensions legs (117) in this embodiment is adjustable by means of internal spring button catches detailed in FIGS. 7*b* and 7*c*. As such there is a single hole (38) in the telescoping extension (118) that a button catch (40) of a spring button catch (39) protrudes from, and number of holes (38) in the extension leg itself corresponding to various height settings. By such means, lengthening of said extension legs (117) works to raise the back of the table top (6). Also important to such conversion, lengthening the telescoping extension legs (117) shifts the angle of the table (6) in relation to the seat (7) and so angle between of the pedestal support (10) in relation to said table. Given said circumstances, the pedestal connector pipe (18) requires either no cam grip (22*a*) or cam grip loosening and adjustment.

Such raising of the table top also changes the angle of the rear table legs pointing them out in the direction perpendicular to the table top (6). So positioned, the angle of the table legs work to give the assembled work station a charming stance as the two angled legs, no longer vertical, directly support any force applied directly to the table top (6). Where there is higher traffic the risk of such legs being kicked increases dramatically. As such it is recommended that they be returned to a vertical position beneath the table top by means of loosening and tightening the cam grip (22).

FURTHER REGARDING HARDWARE: In its fundamentals, the briefcase workstation is unprecedented in portable furniture. As to the details, there are a wide variety of means by which the legs might attach and detach, or swivel and latch, or connect or telescope. Legs might even be made to fold or swivel out of the case. As such, this is not, nor can it be, a comprehensive presentation of alternate embodiments.

Pipe Leg Reinforcement

Expanded polymeric materials, mentioned in U.S. Pat. No. 6,443,521 B1 Nye et al Sep. 3, 2002 (C3/L28), is well known existing technology used to strengthen hollow materials and might be applied to improve the strength of hollow legs. Alternately, a plastic insert, that fits snugly inside a pipe leg and keeps said leg from bending, also works to reinforce that leg where hardware wants reinforcement, a channel or recess is cut, or a peg, for twist locking leg components is installed. Rivets might hold the plastic insert. Such plastic inserts might also hold the hardware for rotatably adjustable feet.

A Final Note on Portation

While the BRIEFCASE WORKSTATION is fitted with a simple handle it is easily adapted to other means of portation. Possibilities include a side handle on the short side of the case, this to make it more comfortable to carry in crowds, a shoulder strap, back straps. It might even be fitted with two detachable or fixed wheels and an extendable handle as is popular these days in airports, or in a larger version simply roll on four such detachable wheels behind a short pull or leash. There are also many ways to hold and keep detached legs when not in use, many ways in which the two halves of the case can connect and disconnect, many ways the case can lock and unlock. Note that while a pedestal hole is used in every case to fix the seat because it is so efficient and workless, there are also many other ways to so fix the seat and the table top together so as to win the stability such connection affords. People who are uncomfortable "breaking" the seat case may seek other means of connecting table and seat compartments.

The invention claimed is:

1. An equipment case that is convertible into a table and seat comprising:

a. a first compartment usable as a seat that is open on one side;

b. a second compartment usable as a table that is open on one side;

c. first means for detachably coupling said first compartment and said second compartments with said open sides facing each other to form the case, the equipment case configured such that when first and second compartment are coupled to form the case, there is room inside the case for other equipment;

the equipment case including second means for detachably coupling said second compartment when serving as a table to said first compartment when serving as a seat;

wherein the equipment case, when acting as a seat and table, said second compartment is supported by at least two legs, at least one of said second compartment legs detachably coupling to said first compartment, the other leg extending to a supporting surface or to the ground; and wherein which said detachable coupling of first and second compartment as seat and table is effected by one of said second compartment legs being rotatably coupled inside said second compartment, said rotatably coupled leg rotating out of said second compartment functioning as a table to couple with said first compartment functioning as a seat.

2. The equipment case as set forth in claim 1 in which said rotatably coupled second leg is made rotatable by being fixed to a cross member that is rotatably coupled inside said second compartment such that said rotatably coupled leg may be rotated 90 degrees out of said second compartment functioning as a table to couple to first compartment functioning as a seat.

3. The equipment case as in claim 1 in which said rotatably coupled second compartment leg may be rotated more than 90 degrees out of said second compartment functioning as table to detachably couple at a wider angle and also couple to said first compartment functioning as seat.

4. The equipment case as in claim 1 in which said rotationally coupled second leg couples to said first compartment by means of an adjunct or extension.

5. The equipment case as in claim 1 whereby said at least one of said second compartment leg that extends to a supporting surface or to the ground may be height adjustable in order to adjust the angle of tabletop.

* * * * *